United States Patent [19]

Cazes

[11] Patent Number: 4,747,703

[45] Date of Patent: May 31, 1988

[54] BAG MADE OF FLEXIBLE SYNTHETIC MATERIAL AND POSSESSING A STIFFENING AND STABILIZING MEANS

[75] Inventor: Michel Cazes, Vittel, France

[73] Assignee: Societe Generale des Eaux Minerales de Vittel, Vittel, France

[21] Appl. No.: 923,889

[22] Filed: Oct. 28, 1988

[51] Int. Cl.[4] ..... B65D 33/02

[52] U.S. Cl. ..... 383/119; 383/104

[58] Field of Search ..... 383/119, 104, 62

[56] References Cited

U.S. PATENT DOCUMENTS 2,650,016 8/1953 McMillan ..... 383/119

3,118,588 1/1964 Noble ..... 383/119

FOREIGN PATENT DOCUMENTS 651638 4/1951 United Kingdom ..... 383/119

651804 4/1951 United Kingdom ..... 383/119

*Primary Examiner*—Willis Little

*Attorney, Agent, or Firm*—Weiser & Stapler

[57] ABSTRACT

The front face of a bag, made of flexible material obtained from a strip of synthetic film shaped to define a bottom and a pair of side walls connected by a stiffening and gripping zone to the front face, from which contents of the bag are poured, is provided with structure for stiffening and stabilizing said bag.

22 Claims, 10 Drawing Sheets

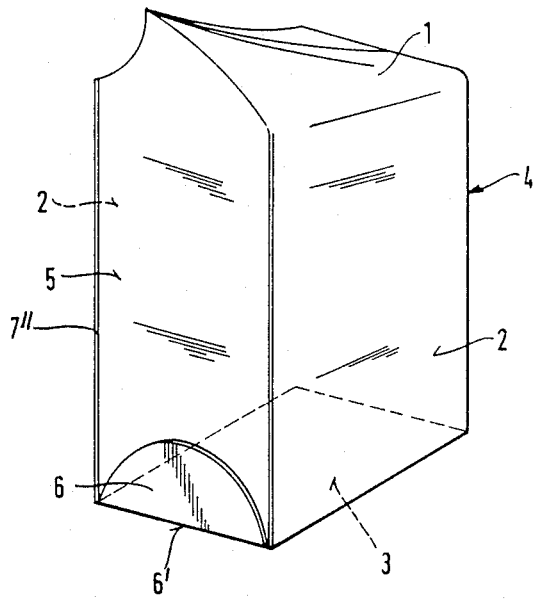
Fig. 1
Fig. 2
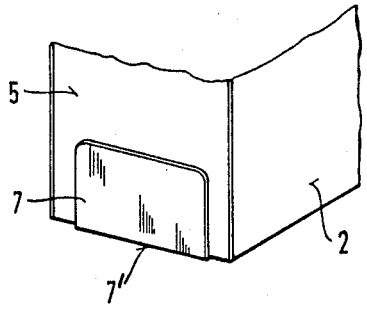
Fig. 3
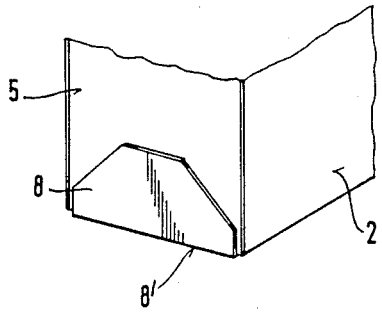
Fig. 4
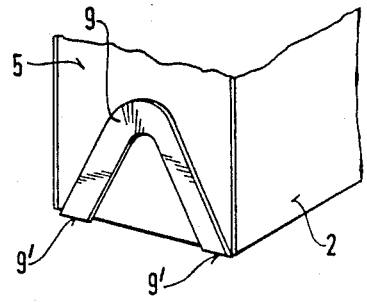
Fig. 5
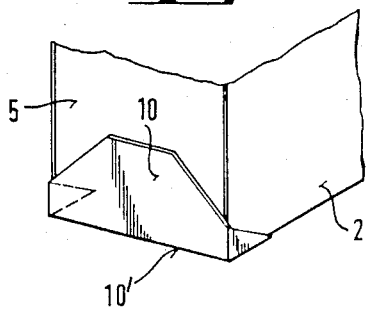

BAG MADE OF FLEXIBLE SYNTHETIC MATERIAL AND POSSESSING A STIFFENING AND STABILIZING MEANS

The subject of the present invention is a bag made of flexible synthetic material of the type obtained from at least one strip of synthetic film shaped so as to define, by means of welds, a bottom, on which the bag rests, two side walls, a stiffening and gripping zone connecting the two side walls, and a front face likewise connecting the two side walls, the said front face corresponding to the side on which the content of the bag is poured after the latter has been opened.

Bags of this type are known per se. They were, for example, but in a non-limiting way, the subject of French Patent Applications 75-18258, 78-04233, 80-02187 and 83-18257 in the applicant's name, express reference being made to these applications here.

These bags give full satisfaction, and the results published in the above-mentioned applications are obtained.

However, as regards large-capacity bags, it emerged that it was still necessary to perfect the stability of the bag, to prevent it from falling over onto its sides or tipping forwards.

The present invention proposes to overcome these disadvantages.

This result is achieved by means of a bag made of flexible synthetic material, of the type obtained from at least one strip of synthetic film shaped so as to define, by means of welds, a bottom, on which the bag rests, two side walls, a gripping and stiffening zone connecting the two side walls, and a front face likewise connecting the two side walls, the said front face corresponding to the side on which the content of the bag is poured after the latter has been opened, characterized in that the front face is provided with a means of stiffening and stabilizing the bag.

The retaining and stabilizing means can consist, for example, of a rigid buttress. The said buttress can be made of any material, for example cardboard, PVC or any other synthetic material.

The buttress can also perform other functions, such as, for example, participate in the closing of the bag.

According to another embodiment, the retaining means will consist of one or more vertical stiffening ribs arranged on the said side face.

According to another embodiment of the invention, the stiffening and stabilizing means is produced as a result of the formation of folds on the front edges of the bag or the provision of stiffening or structuring elements on the said edges.

Stiffening can also be obtained by two essential means:

a modification of the structure of the film, the provision of an element forming an extra thickness, hence a stiffening element.

These two means can be used or put into effect on the inside or outside of the bag.

Processes for providing the said bags with the said retaining and stabilizing means are also a subject of the invention.

The invention will be understood better by means of the following description made with reference to the attached drawings, in which:

FIG. 1 is a front perspective view of a bag according to the invention with a buttress;

FIGS. 2 to 5 illustrate bags of the type of that in FIG. 1, with different forms of buttresses;

Figure 13A:
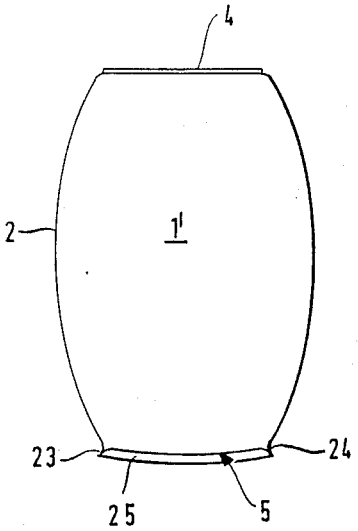
FIG. 13 is a perspective view of a bag according to the invention, with two front stiffening ribs.
Figure 13:
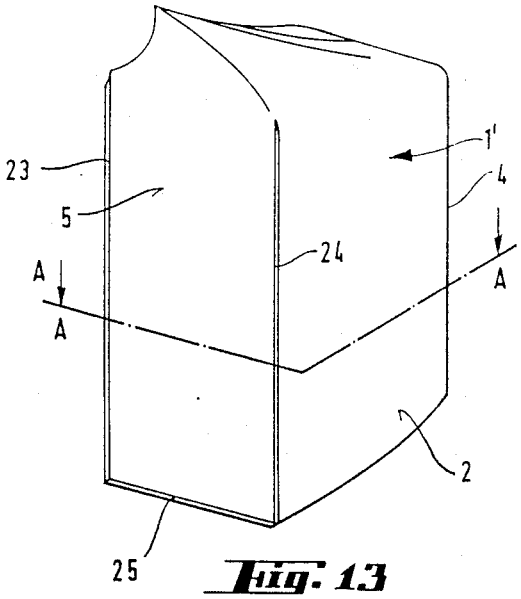
Figure 14A:
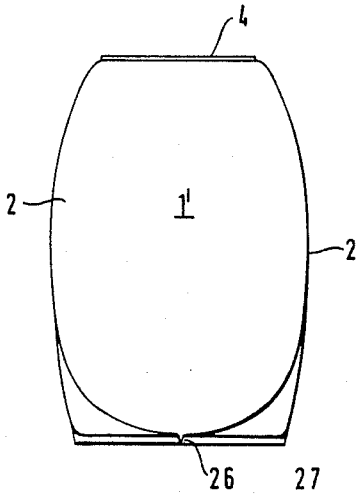
Figure 14:
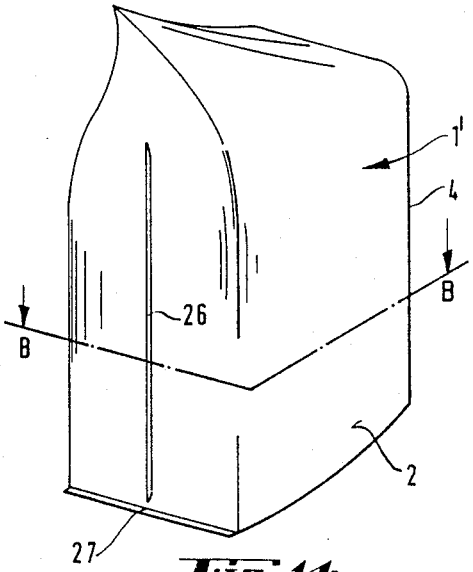
Figure 15:
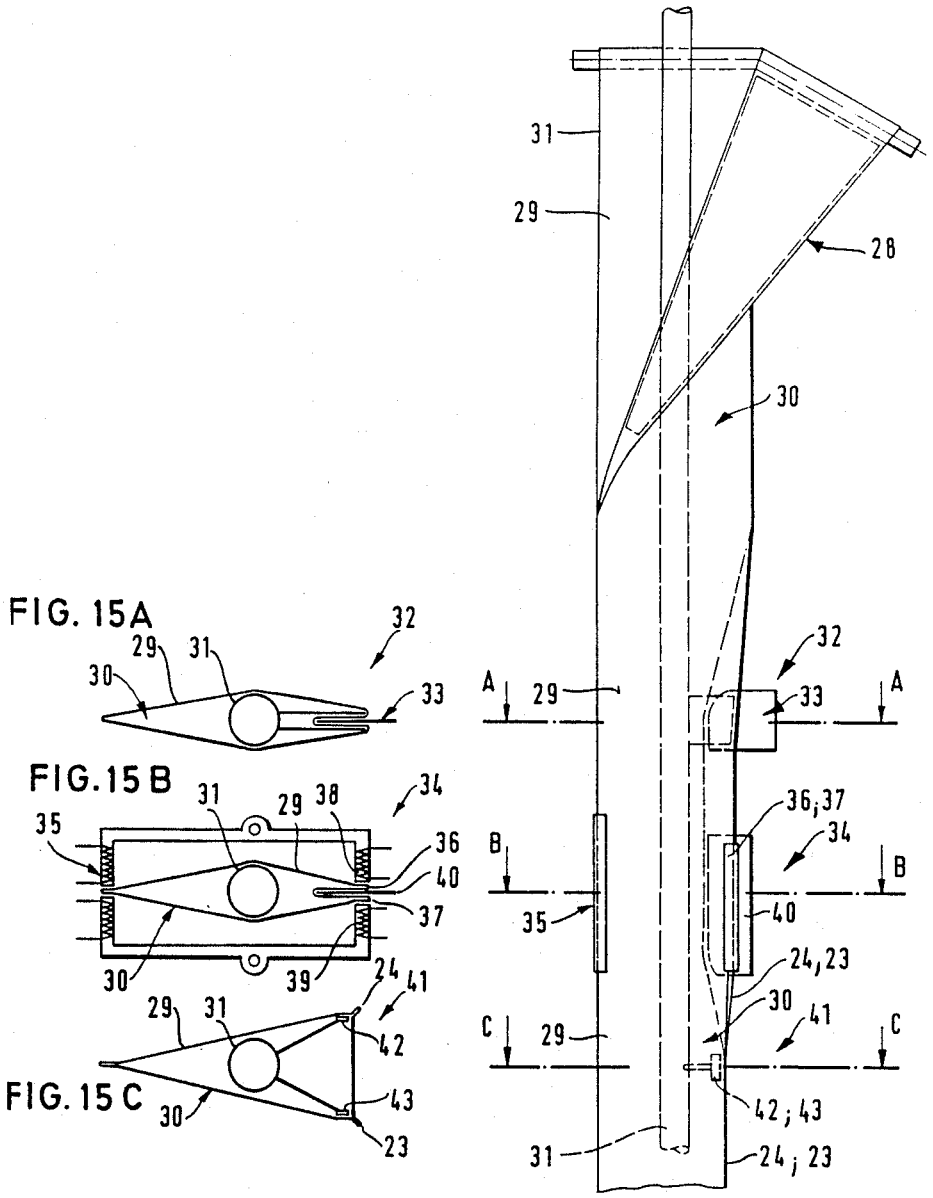
Figure 16:
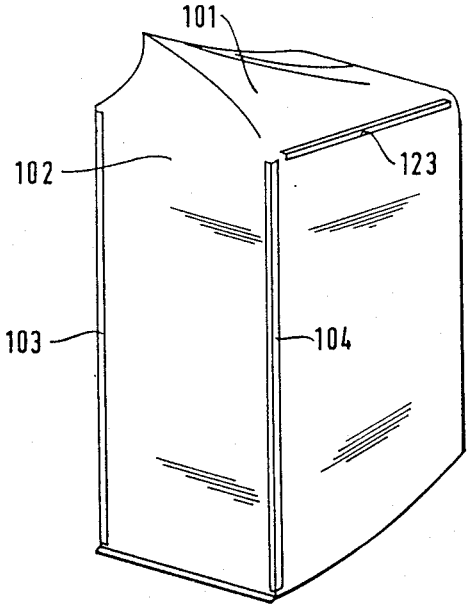
Figure 17:
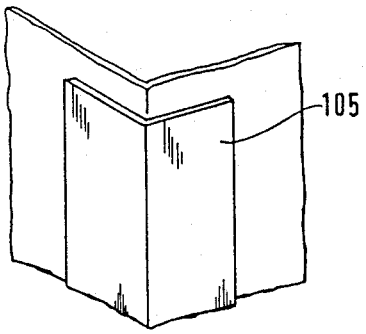
Figure 24:
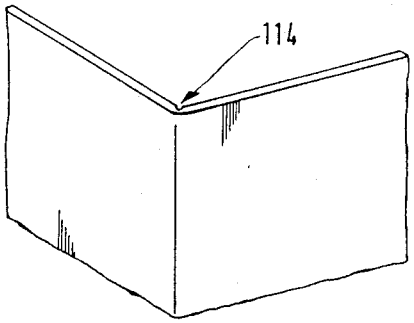
Figure 25:
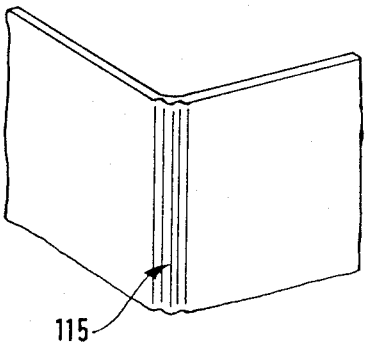
Figure 26:
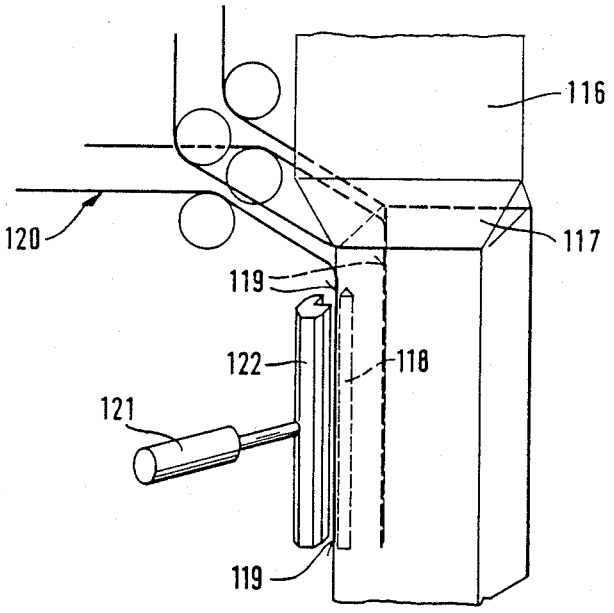
Figure 27:
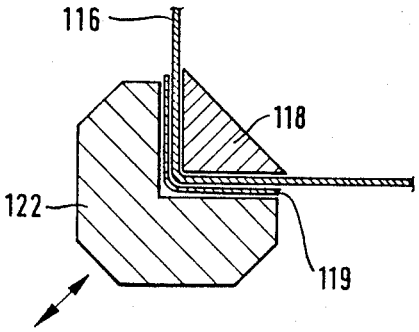

FIG. 13 A is a cross-section of the bag along line A—A of FIG. 13;

FIG. 14 is a perspective view of a bag according to the invention, with one front stiffening rib;

FIG. 14 B is a cross-section of the bag along the line B—B of FIG. 14;

FIG. 15 shows a machine for forming the ribs of the bags of FIGS. 13 and 14;

FIGS. 15 A, 15 B and 15 C are cross-sections of the shaping machine of FIG. 15 along the lines A—A, B—B and C—C respectively;

FIG. 16 is a perspective view of a bag according to the invention, with stiffening of the front edges;

FIGS. 17 to 25 illustrate diagrammatically various embodiments making it possible to achieve the desired stiffening at the front edges of the bag;

FIG. 26 is a diagrammatic view of an apparatus for producing the bags of FIGS. 16 to 25;

FIG. 27 is a diagrammatic sectional view illustrating a particular embodiment of the apparatus of FIG. 26, corresponding to the bag of FIG. 17.

Reference will first be made to FIG. 1.

According to this embodiment of the invention, a bag (1) comprising essentially:

two side walls such as (2);

a bottom (3), on which it is to rest;

a stiffening and gripping zone (4) connecting the two side walls (2) to one another;

and a front face (5) likewise connecting the two side walls (2) to one another;

is provided, according to the invention, with a stiffening and stabilizing means.

This can be:

a rigid buttress (6)

and/or one or more vertical ribs (7).

The buttress will preferably be arranged in such a way that, when the bag is placed on a plane surface, the base (6') of the buttress can bear on the said plane surface.

It can be made of any material, for example synthetic material, if appropriate recycled material to limit the cost price, cardboard, etc, in a non-limiting way.

It can also assume any form compatible with the function assigned to it, such as, for example, but in a non-limiting way:

a semicircular form as shown in FIG. 1;

a four-cornered form (7), as shown in FIG. 2;

a trapezoidal form (8), truncated if appropriate, as shown in FIG. 3;

a recessed form (9) in the shape of a horse shoe, as shown in FIG. 4;

a trapezoidal form (10) as shown in FIG. 5, the base angles being folded against the side walls to reinforce stabilization even further.

It will be seen that, in all the illustrative forms proposed, there is a contact line (6', 7', 8', 9', 10' respectively) between the buttress (6, 7, 8, 9, 10) and the surface on which the bag provided with it rests.

Figure 6:
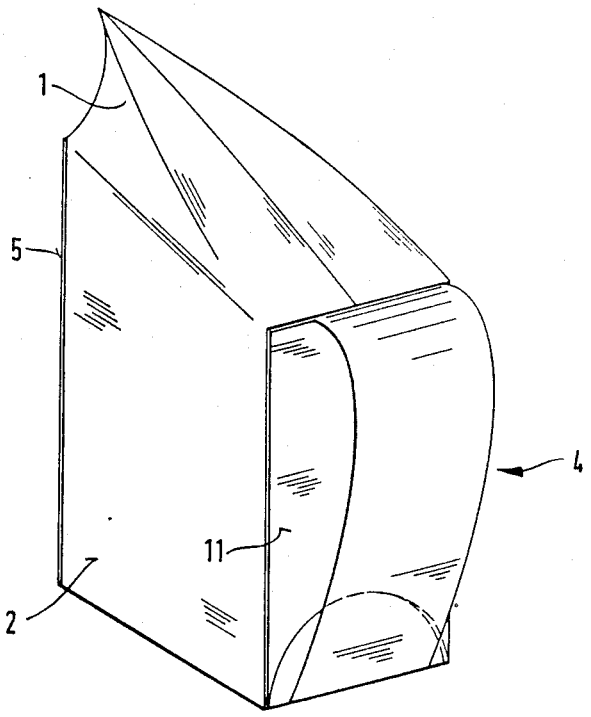
FIG. 6 is a rear perspective view of a bag with a gripping handle with a shape matching that of the buttress of FIG. 1.

Optionally, as shown in FIG. 6, in order to save material, the buttress (6) can be cut out from the element (11) attached in the abovementioned stiffening and gripping zone (4).

Other forms of front buttress can be used, and they will advantageously perform one or more additional functions besides the desired function, that is to say the stiffening and stabilization of the bag.

Thus, it can be very advantageous if the buttress participates in the closing of the bag once the latter has been opened.

Figure 7:
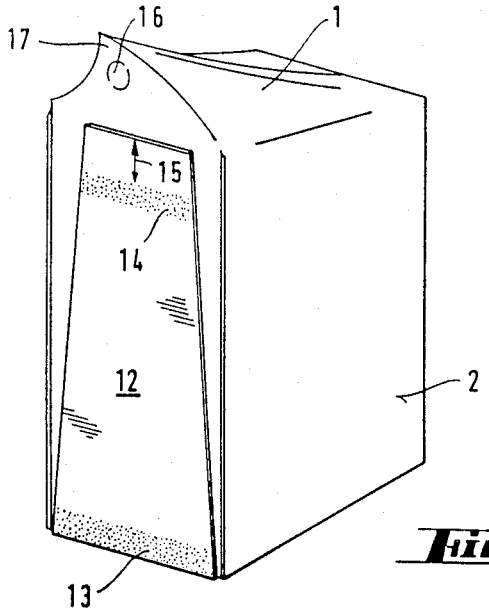
FIG. 7 illustrates an oblong buttress occupying the entire front face of the bag.

In the embodiment shown in FIGS. 7, 8 and 9, to which reference will now be made, the buttress is of a general oblong and trapezoidal form. It is made integral with the bag (1) by means of two welding or bonding lines (13, 14), one (13) located substantially at the base of the front face and the other (14) arranged slightly offset relative to the upper part of the said buttress (12), thus defining a zone (15) open on three sides, in particular in the direction of the top of the bag where the pouring orifice (16) is to be made.

Figure 8:
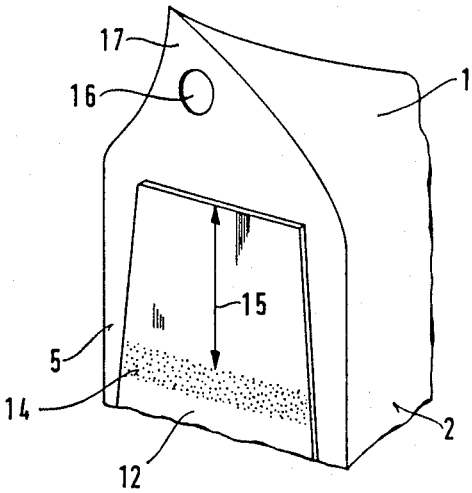
FIGS. 8 and 9 show, enlarged, the configuration of FIG. 7 which participates in the closing of the bag.

This structure of the upper part of the bag is shown enlarged in FIG. 8.

Figure 9:
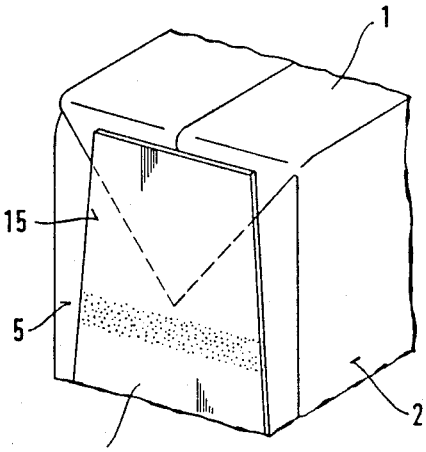

To close the bag again after first use, the upper horn (17) possessing the orifice (16) is folded against the buttress (12) and inserted between the zone (15) and the front face of the bag, as shown in FIG. 9.

Figure 10:
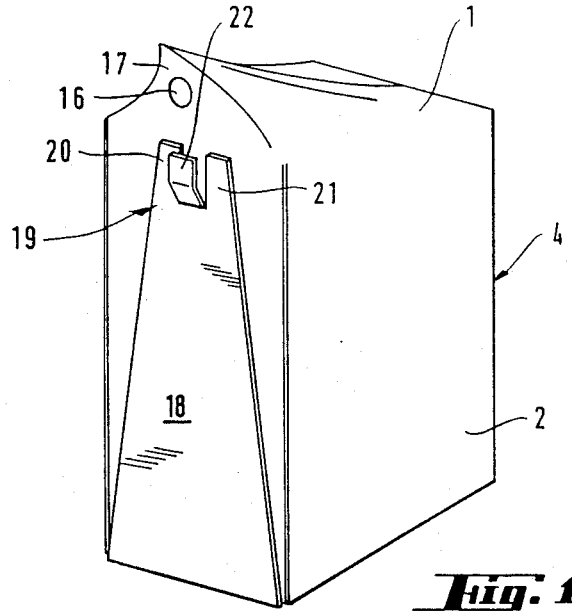
FIG. 10 illustrates an oblong buttress having means of closing the bag.
Figure 11:
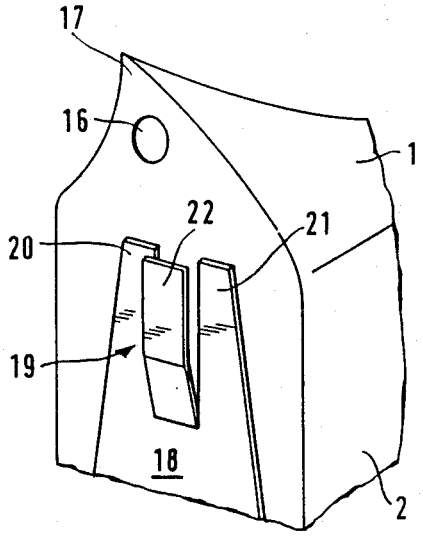
FIGS. 11 and 12 show, enlarged, the configuration of FIG. 10, illustrating the method of closing the bag.
Figure 12:
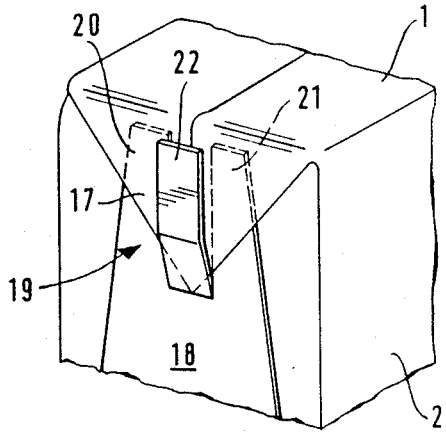

In the alternative form illustrated in FIGS. 10, 11 and 12, the function of which is completely identical to the preceding function, the bag has a buttress (18) provided in its upper part with a means (19) of closing and nipping the upper horn (17) of the bag. As shown in FIG. 11, the means (19) consist essentially of two tabs (20,21) substantially symmetrical relative to the longitudinal axis of the buttress (18) and interacting with a finger (22) located between the said tabs.

The bag is closed by folding down the upper horn (17) of the bag, so as to place it over the tabs (20,21) and under the finger (22), where it is retained as a result of the nipping effect obtained in this way.

The buttress of the type described above and illustrated in FIGS. 1 to 12 can be attached to the bag by any means such as welding or bonding, at any moment during the process of manufacturing and filling the bag.

For example, the buttress (6, 7, 8, 9, 12, 18) can be attached by means of a process similar to that making it possible to fasten the stiffening and gripping element (11), as described by way of example in French Patent Application No. 83-18257 in the applicant's name.

According to a second embodiment, the stiffening and stabilizing means can consist of one or more vertical ribs (7), already shown in FIG. 1. In this illustration, these ribs (7) are used together with a buttress, such as (6), of the type illustrated above.

The rib or ribs (7) can also contribute alone to obtaining the desired result, that is to say the stiffening and stabilizing of the bag.

Thus, FIGS. 13 and 13 A show a bag (1') equipped with two vertical front ribs (23, 24) of this type.

Advantageously, the lower edge of the front face of the bag (1') in contact with the surface, on which the latter is placed, will also be reinforced by means of a weld (25).

FIGS. 14 and 14 B illustrate an embodiment of the same type as the preceding embodiment, but with a single stiffening and stabilizing rib (26), if appropriate reinforced by a weld (27) on the lower edge of the front face.

The ribs (23, 24, 26) can be produced by way of non-limiting example, by means of the following apparatus.

A shaper (28) of a type known to a person skilled in the art, to which a film (29) is delivered to be shaped in a continuous tube (30) and then filled with the liquid to be packaged and converted into individual bags or pouches by means of a central pipe (31) among other things, contains processing stations and stations for shaping the rib or ribs (23, 24, 26).

The production of two ribs (23, 24) will be taken as an example.

At the first station (32), the film at this stage being ready to be welded so as to be converted into a continuous tube (30), a shaper (33) into which the film passes, gives the latter a W shape.

At the station (34) located downstream of this, the following procedures are carried out jointly or in succession:

the film (29) is welded to shape it into a tube (30) in the conventional way by means of a welding jaw (35);

the abovementioned W-shaped fold is welded at its two edges (36, 37) by means of two welding elements (38, 39), an insulating element (40) being interposed to prevent the two edges (36, 37) from being welded to one another.

Finally, the station (41) located downstream is equipped with two spacer fingers (42, 43) which unfold the W-shaped zone so as to give it the desired structure for forming the front face of the future bag.

Reference will now be made to FIG. 16. The bag (101) according to the invention has on its front face (102) two edges (103, 104) which are stiffened so as to give the bag stability and shape.

This result is obtained either as a result of the formation of folds or by the provision of stiffening or structuring elements at the said edges.

These elements are attached to the surface of the sheath forming the bag by means of bonding, sealing, welding or any other suitable process.

As will be illustrated later, the said elements will be made from a single material or a composite material, flat or angular, etc.

Thus, FIG. 17 shows a reinforcement (105) attached to the outside of the bag and forming an angle, the vertex of which marks the edge of the bag. The reinforcement (105) can have any opening angle. It is also possible to give it a certain elasticity, so that the angle remains clearly defined even when the bag is completely filled.

Figure 18:
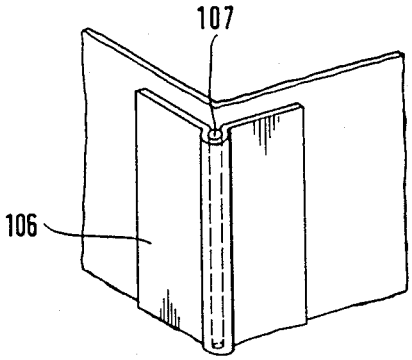

FIG. 18 illustrates a similar structure with an outer reinforcement (106) which is attached to the edge and surrounds an insert (107) arranged parallel to the said edge. The insert can be made of any material.

Figure 19:
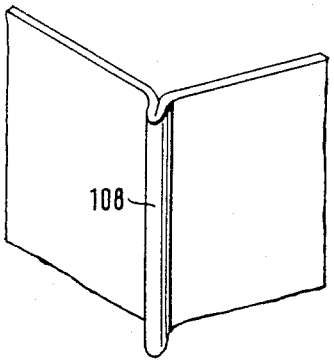

In the embodiment of FIG. 19, the reinforcement (108) is obtained by pinching the edge of the bag, as illustrated above.

Figure 20:
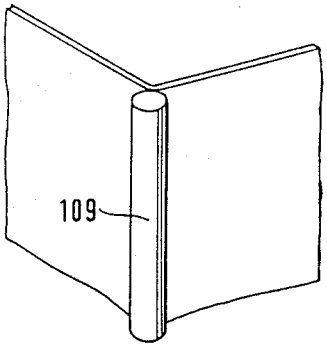

In FIG. 20, the same result is obtained by attaching a bead (109) along the edge.

Figure 21:
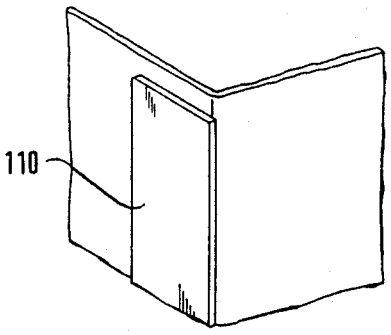

In FIG. 21, the edge is marked along the margin of a reinforcing strip (110).

Figure 22:
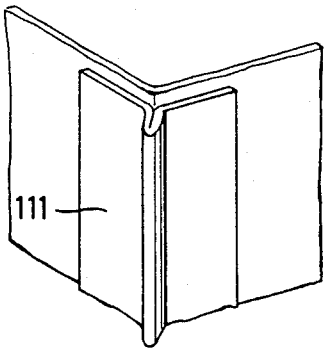

In FIG. 22, the corner of the outer reinforcement (111) is pinched, thus marking the edge in a more pronounced way.

Figure 23:
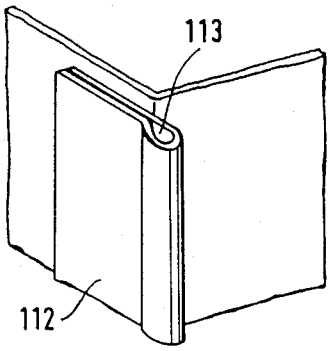

Finally, the embodiment illustrated in FIG. 23 shows an outer reinforcement (112) folded back on itself and defining a longitudinal cavity (113) which can be empty or inflated, thus achieving a more pronounced stiffening.

In the embodiments illustrated in FIGS. 24 and 25, the film constituting the bag is weakened either on the inside (114) or on the outside (115).

In this case, folding can be carried out by means of hot or cold stamping.

Reference will now be made to FIGS. 26 and 27 which illustrate an apparatus making it possible to obtain the embodiments of FIGS. 17 to 23.

The stiffening element will preferably be fitted when the film is shaped from a sheath on a shaper predetermining the form and dimensions of the finished pack. A feed system will convey the stiffening element which will be attached to the film sheath on the shaper.

Thus, the bags according to the invention are obtained from a sheath (116) which passes over a die (117). This die possesses one or more shapers (118) to form the front edges.

At the shaper (118), the stiffening element (119), coming from a supply reel (120), is attached by welding, bonding or sealing by means of an appropriate device (121), its type being governed by the fastening method, that is to say welding, bonding or sealing. The device (121) will have, for example, a head (122) of a profile matching that of the shaper (118).

The system operates in an alternating manner, that is to say, when a bag is being filled, the film feed is stopped and the device attaches a stiffening element to the bag which is being shaped.

The stiffening element will be cut automatically, before or during fitting, to the necessary length, for example the length of the edge corresponding to the filled and closed bag.

According to an alternative embodiment, the upper edges of the bag will likewise be reinforced as indicated by the reference number (123). The structure of this horizontal reinforcement will be identical to that illustrated in FIGS. 17 to 25 for the vertical reinforcement.

It will be fitted in the way indicated in FIG. 26, from a supply (124) and according to a method of operation identical to that described above regarding the vertical reinforcement.

It will be appreciated that the invention applies to all the embodiments, in particular irrespective of the type of materials used.

I claim:

1. In a bag made of flexible synthetic material and of the type obtained from at least one strip of synthetic film shaped to define, by means of welds, a bottom on which the bag rests, two side walls, a stiffening and gripping zone connecting the two side walls, and a front face connecting the two side walls, said front face corresponding to the side from which the content of the bag is poured after the bag has been opened, the improvement wherein the front face is provided with a means of stiffening and stabilizing the bag.

2. The bag of claim 1 wherein the stiffening and stabilizing means is a rigid buttress.

3. The bag of claim 2 wherein the buttress is arranged so that when the bag is placed on a planar surface, base portions of the buttress can bear on the planar surface.

4. The bag of claim 2 wherein the buttress has a form selected from the group consisting of a semicircular form, a four-cornered form, a trapezoidal form, a truncated trapezoidal form, a recessed horse-shoe form, and a trapezoidal form with folded-back base angles.

5. The bag of claim 2, 3 or 4 wherein the buttress is cut from an element attached in the stiffening and gripping zone.

6. The bag of claim 2 wherein the buttress also participates in closing of the bag.

7. The bag of claim 6 wherein the buttress is generally oblong in form, and is made integral with the bag by means of two welding or bonding lines, one arranged substantially at the base of the front face and the other being slightly offset relative to upper portions of the buttress, to define a zone which is open on three sides.

8. The bag of claim 7 wherein the zone is open in the direction of the top of the bag, at a pouring orifice.

9. The bag of claim 6 wherein the upper portions of the buttress are provided with a means for closing and nipping an upper horn of the bag.

10. The bag of claim 9 wherein the means for closing and nipping the upper horn is comprised of two tabs substantially symmetrical relative to the longitudinal axis of the buttress and interacting with a finger located between the tabs.

11. The bag of claim 1 wherein the stiffening and stabilizing means comprising at least one vertical rib.

12. In an apparatus for shaping the bag of claim 11 from a film which is converted into a continuous tube on a first shaper and then filled with a liquid to be packaged and converted into individual bags or pouches, the improvement comprising:

a second shaper for receiving the film and for providing the film with a W-shape;

a station located downstream of the second shaper in which the W-shaped fold is welded at its two edges by means of two welding elements, with an insulator interposed to prevent the two edges from being welded to one another; and a station located downstream of the station for welding the W-shaped fold, and including a pair of spacer fingers which unfold the W-shaped fold so as to form the front face of the bag.

13. The bag of claim 1 wherein the stiffening and stabilizing means is produced by forming folds on front edges of the bag or by providing stiffening or structuring elements on said front edges.

14. The bag of claim 13 wherein the stiffening and stabilizing means is an outer reinforcement forming an angle, the vertex of which marks the edge of the bag.

15. The bag of claim 14 wherein the outer reinforcement further includes an insert.

16. The bag of claim 14 wherein the corner of the outer reinforcement is pinched.

17. The bag of claim 14 wherein the outer reinforcement includes a bead made along the edge of the bag.

18. The bag of claim 14 wherein the edge is marked along the margin of a reinforcing strip.

19. The bag of claim 14 wherein the outer reinforcement is folded back on itself, defining a longitudinal cavity which can be empty or inflated.

20. The bag of claim 14 wherein the edge is marked by weakening of the film of the bag on the inside or on the outside.

21. The bag of claim 13 wherein upper edges of the bag are also reinforced by a stiffening means.

22. An apparatus for producing the bag of claim 13, comprising:

means for supplying a stiffening element;

a die for shaping a film sheath; and a shaper interacting with a head having a profile matching that of the shaper, to fix the stiffening element to the film sheath by means of welding, bonding or sealing.

* * * * *

UNITED STATES PATENT AND TRADEMARK OFFICE

CERTIFICATE OF CORRECTION

PATENT NO. : 4,747,703

DATED : May 31, 1988

INVENTOR(S) : MICHEL CAZES

It is certified that error appears in the above-identified patent and that said Letters Patent is hereby corrected as shown below:

On the cover page:

At item [22], change "1988" to --1986--.
After item [22], insert:

--[30] Foreign Application Priority Data

May 6, 1985 [FR] France.....85 06987
February 28, 1985 [FR] France....85 03100--.

Signed and Sealed this

Twentieth Day of March, 1990

*Attest:*

JEFFREY M. SAMUELS

*Attesting Officer*

*Acting Commissioner of Patents and Trademarks*